US008820001B1

(12) United States Patent
Hunter et al.

(10) Patent No.: US 8,820,001 B1
(45) Date of Patent: Sep. 2, 2014

(54) ROOF VALLEY RAIN WATER DIVERTER

(71) Applicants: Alan Hunter, Nutley, NJ (US); Oleksandr Goshko, Philadelphia, PA (US)

(72) Inventors: Alan Hunter, Nutley, NJ (US); Oleksandr Goshko, Philadelphia, PA (US)

( * ) Notice: Subject to any disclaimer, the term of this patent is extended or adjusted under 35 U.S.C. 154(b) by 0 days.

(21) Appl. No.: 14/084,525

(22) Filed: Nov. 19, 2013

Related U.S. Application Data

(60) Provisional application No. 61/727,980, filed on Nov. 19, 2012.

(51) Int. Cl.
*E04D 13/00* (2006.01)
*E04D 13/147* (2006.01)
*E04D 13/04* (2006.01)

(52) U.S. Cl.
CPC ..... *E04D 13/0445* (2013.01); *E04D 13/147* (2013.01); *E04D 13/0481* (2013.01)
USPC ..... 52/13; 52/60; 52/96; 52/97; 52/198

(58) Field of Classification Search
USPC ..... 52/11, 13–15, 58, 60–62, 95–97, 198
See application file for complete search history.

(56) References Cited

U.S. PATENT DOCUMENTS

| | | | | |
|---|---|---|---|---|
| 373,129 | A | 11/1887 | Carroll | |
| 2,227,583 | A * | 1/1941 | Hoess | 52/276 |
| 2,258,078 | A | 10/1941 | Tennison | |
| 3,264,790 | A | 8/1966 | Beals | |
| 3,352,649 | A | 11/1967 | Tennison, Jr. | |
| 4,449,333 | A | 5/1984 | Stratton | |
| 5,115,603 | A | 5/1992 | Blair | |
| 5,333,419 | A | 8/1994 | Hickner | |
| 5,623,787 | A | 4/1997 | Ali | |
| 5,675,939 | A | 10/1997 | Hickner | |
| 6,009,672 | A | 1/2000 | Kuhns | |
| 6,256,933 | B1 | 7/2001 | Kuhns | |
| 6,412,229 | B2 | 7/2002 | Kuhns | |
| 6,584,733 | B2 * | 7/2003 | Wade | 52/14 |
| 7,100,331 | B2 | 9/2006 | Nehring | |
| 7,500,332 | B2 * | 3/2009 | Garcia | 52/58 |
| 7,836,637 | B2 | 11/2010 | Iannelli | |
| 2002/0184980 | A1 * | 12/2002 | Fasnacht et al. | 83/13 |
| 2006/0048456 | A1 * | 3/2006 | Iannelli | 52/13 |
| 2006/0090404 | A1 * | 5/2006 | Lovell | 52/97 |
| 2007/0209289 | A1 * | 9/2007 | Garcia | 52/11 |

* cited by examiner

*Primary Examiner* — Brian Glessner
*Assistant Examiner* — Brian D Mattei
(74) *Attorney, Agent, or Firm* — Hoffmann & Baron, LLP

(57) ABSTRACT

A roof valley water diverter is provided herein for changing direction of rain water flowing through a roof valley. The diverter includes at least first and second side plates joined together to form a trough extending along a longitudinal axis and configured to channel a flow of rain water therethrough. A deflector plate, having opposing first and second faces, is secured to at least the first and second side plates such that the first face intersects the longitudinal axis. At least one gap is defined between the first face and at least one of the first and second side plates. Advantageously, the diverter of the subject invention allows for re-direction of flow of rain water from a roof valley.

9 Claims, 5 Drawing Sheets

ROOF VALLEY RAIN WATER DIVERTER

CROSS-REFERENCE TO RELATED APPLICATION

This application claims priority to U.S. Provisional Patent Application No. 61/727,980, filed Nov. 19, 2012, the entire contents of which are hereby incorporated by reference.

FIELD OF THE INVENTION

This invention relates to structures for diverting roof rain water run-off, particularly, roof valley rain water run-off.

BACKGROUND OF THE INVENTION

Channeling of roof water run-off is desired to minimize possible damage resulting from such run-off. Higher concerns may exist where rain water is channeled into a roof valley defined at the intersection of two or more pitched roof sections. The flow of water through a roof valley may be greater than other flows experienced on a roof due to the inherent concentrating effect of the roof valley's configuration. Flow exiting the roof valley, over the edge of the roof, may not fully pass into a gutter or leader due to its volume. Also, the roof valley discharge may overshoot the gutter or leader because of its inherent built-up momentum.

Devices have been developed in the prior art intended to divert roof valley rain water run-off into a gutter or leader. For example, U.S. Pat. No. 7,836,637 to Iannelli shows a valley diverter for a gutter cover. U.S. Pat. Nos. 6,009,672, 6,256,933 and 6,412,229, all to Kuhns, show a roof valley water collector.

SUMMARY OF THE INVENTION

A roof valley water diverter is provided herein for changing direction of rain water flowing through a roof valley. The diverter includes at least first and second side plates joined together to form a trough extending along a longitudinal axis and configured to channel a flow of rain water therethrough. A deflector plate, having opposing first and second faces, is secured to at least the first and second side plates such that the first face intersects the longitudinal axis. At least one gap is defined between the first face and at least one of the first and second side plates. Advantageously, the diverter of the subject invention allows for re-direction of flow of rain water from a roof valley.

DETAILED DESCRIPTION OF THE INVENTION

Figure 2:
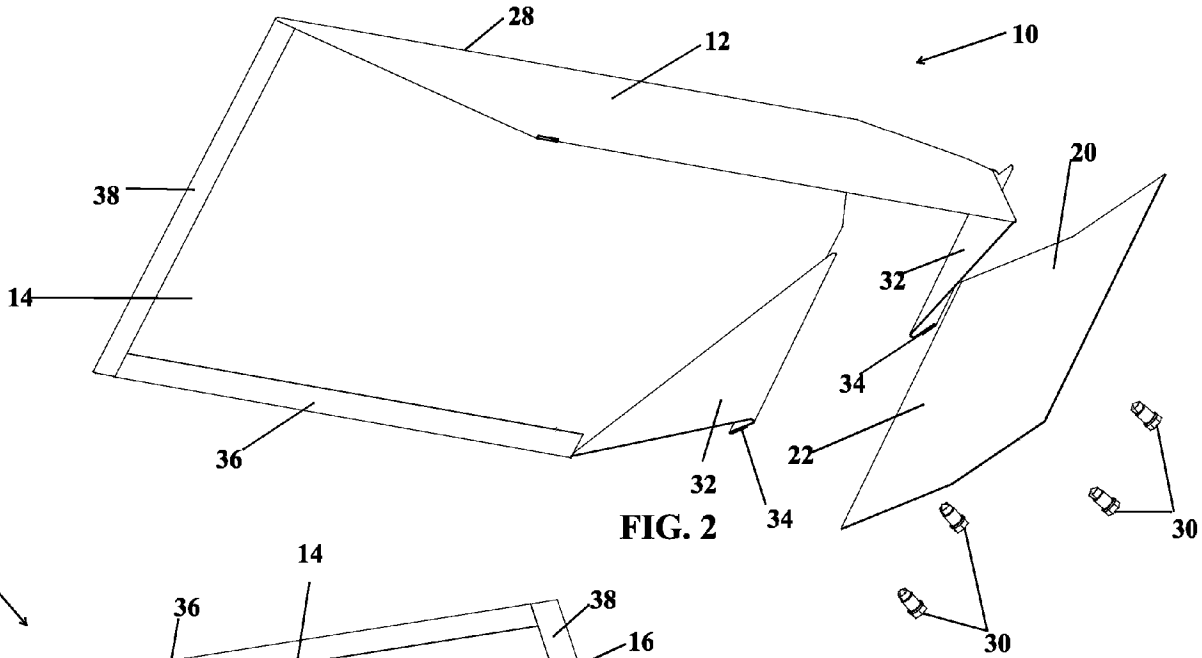
FIGS. 1-2 are exploded views of a diverter formed in accordance with the subject invention.
Figure 1:
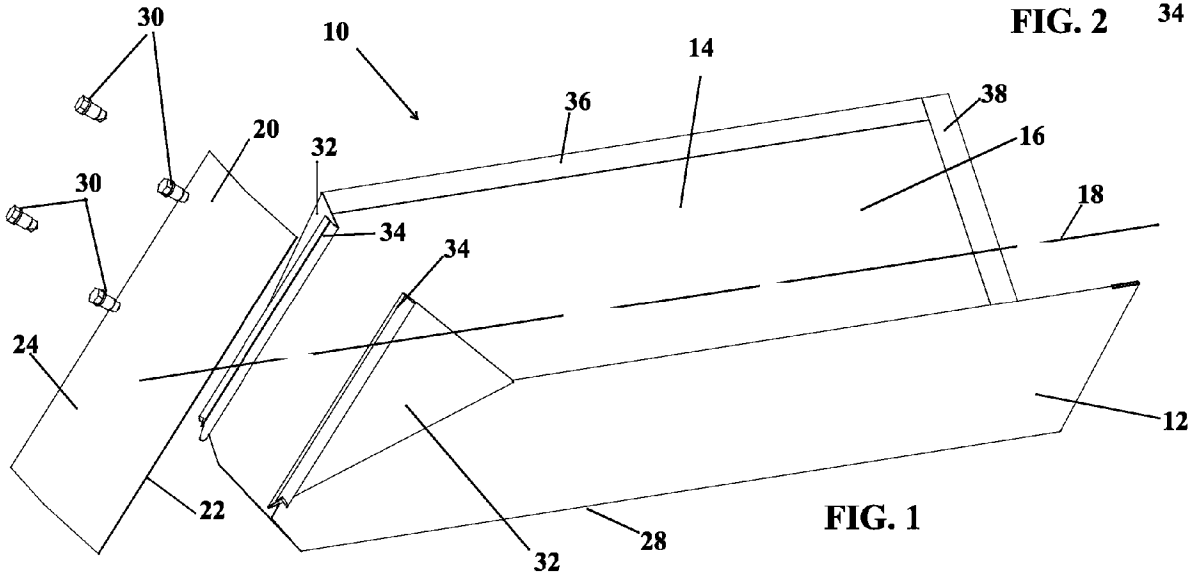
Figure 5:
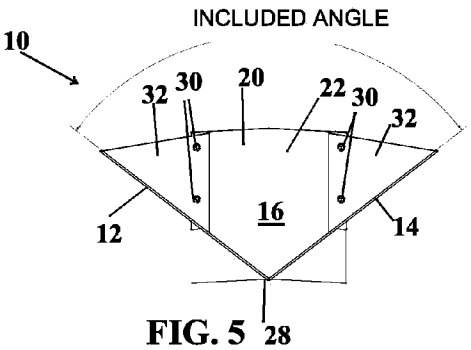
FIGS. 3-8 are different views of the diverter of FIGS. 1 and 2 in an assembled state.
Figure 8:
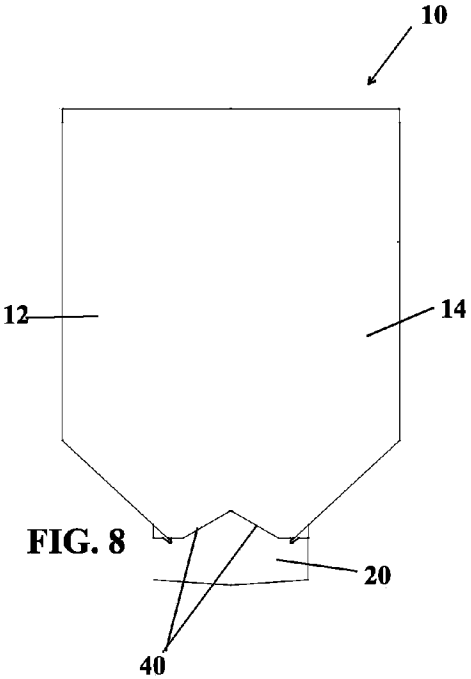
Figure 4:
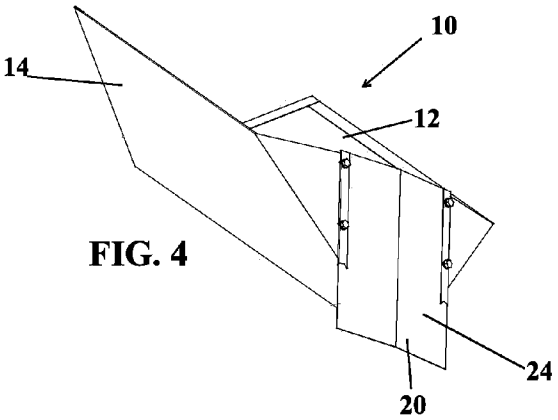
Figure 7:
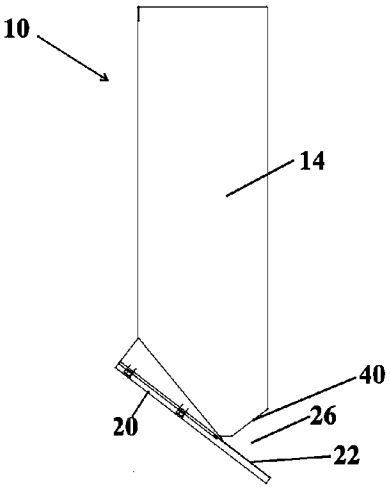
Figure 3:
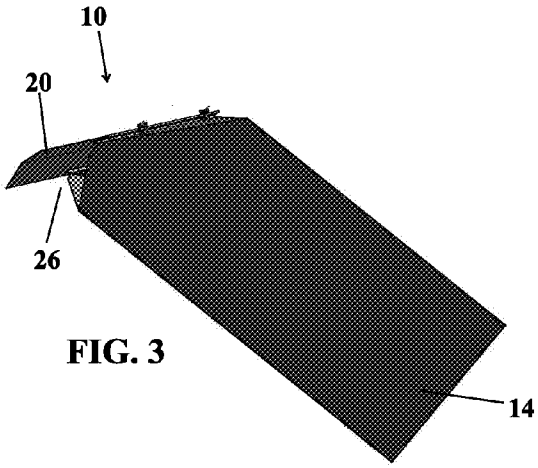
Figure 6:
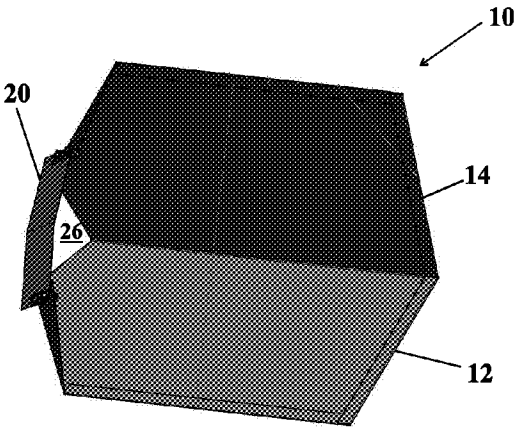
Figure 10:
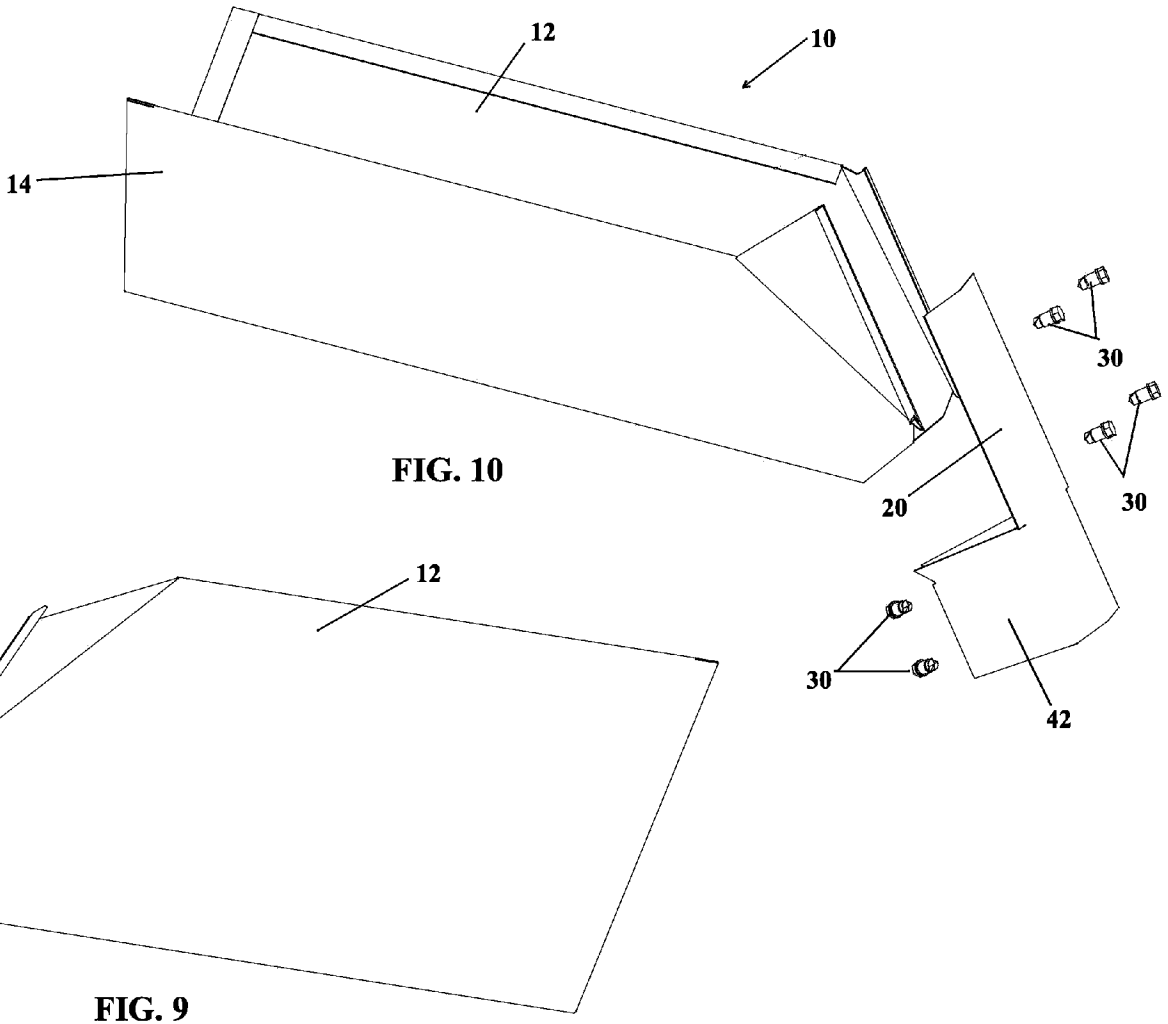
FIGS. 9-10 are exploded views of a second embodiment of a diverter formed in accordance with the subject invention.
Figure 9:
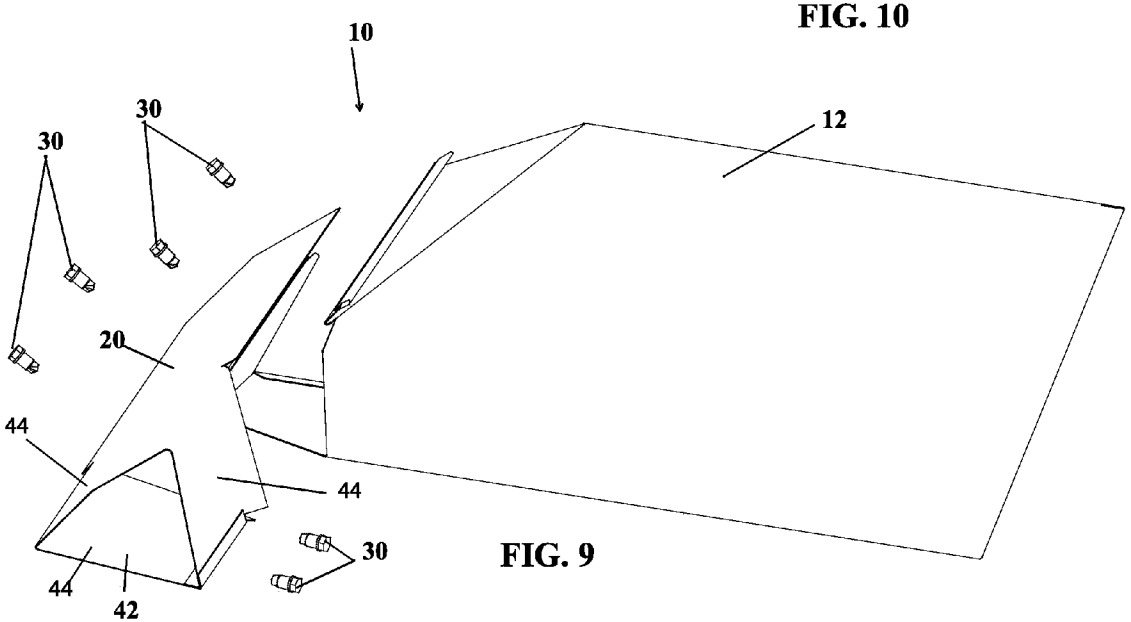
Figure 13:
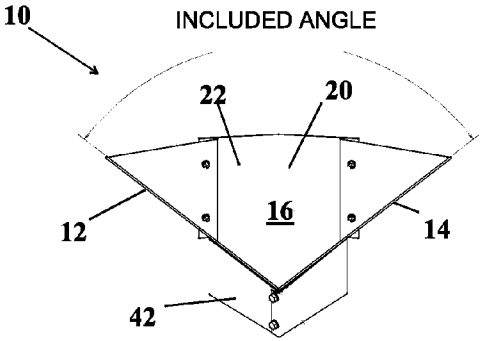
FIGS. 11-16 are different views of the second embodiment of the diverter of FIGS. 9 and 10 in an assembled state; and, FIGS. 17-18 show different variations of a diverter formed in accordance with the subject invention.
Figure 12:
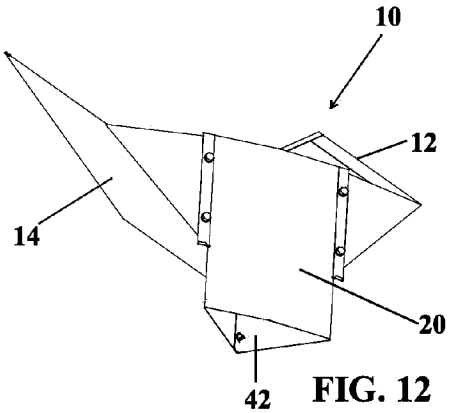
Figure 11:
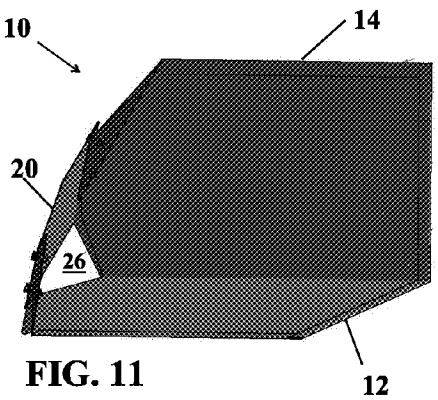
Figure 16:
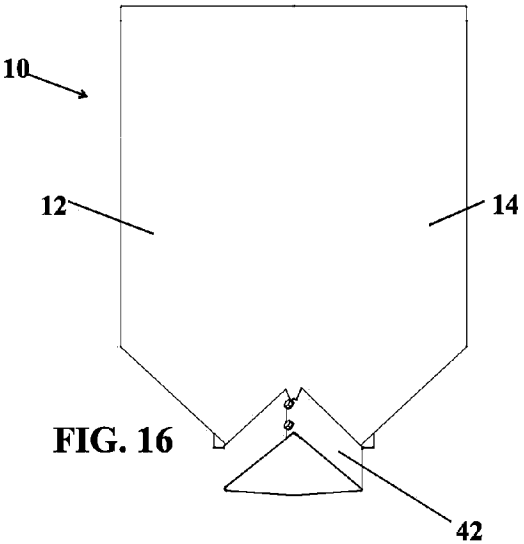
Figure 15:
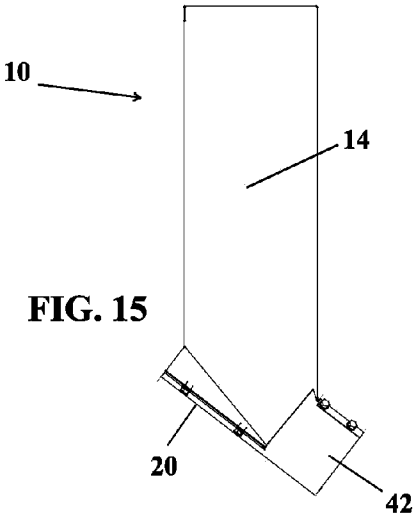
Figure 14:
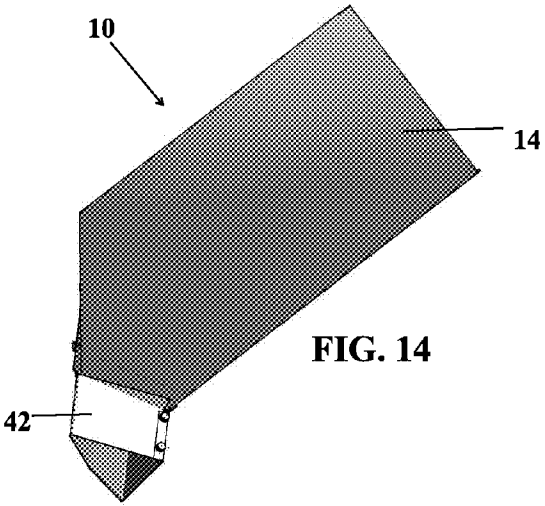

With reference to the Figures, a diverter is shown which is formed to change direction of rain water flowing through a roof valley. As used herein, the term "roof valley" refers to the intersection of two or more adjacent slanted sections of roof. As will be recognized by those skilled in the art, the adjacent sections of roof direct rain water flow into the roof valley. The roof valley channels the collected flow towards an edge of the roof, with typically a gutter or leader being located adjacent thereto. The diverter of the subject invention advantageously allows for re-direction of the channeled flow of rain water from the roof valley into the gutter or leader.

With reference to FIGS. 1-8, a diverter 10 may be provided which includes at least first and second side plates 12, 14 joined together to form a trough 16 extending along a longitudinal axis 18. The trough 16 is configured to channel a flow of rain water therethrough. The diverter 10 also includes a deflector plate 20, having opposing first and second faces 22, 24, secured to at least the first and second side plates 12, 14 such that the first face 22 intersects the longitudinal axis 18. At least one gap 26 is defined between the first face 22 and at least one of the first and second side plates 12, 14. The gap 26 may be defined between the first face 22 and both the first and second side plates 12, 14.

The diverter 10 is configured to be placed into a roof valley with water being collected in the trough 16 and channeled therethrough so as to impinge on the first face 22 of the deflector plate 20 and caused to be re-directed through the gap 26. It is preferred that the deflector plate 20 be configured so as to at least fully overlap the gap 26 as viewed in a direction generally parallel to the longitudinal axis 18. The diverter 10 is located in the roof valley so as to align the gap 26 with a gutter or leader so that the re-directed flow is introduced therein. Also, as shown in the Figures, the deflector plate 20 may be angularly divergent away from portions of the first and second side plates 12, 14. The deflector plate 20 may be placed against the edge of a gutter or leader to minimize movement of the diverter 10 relative to the gutter or leader.

Figure 17:
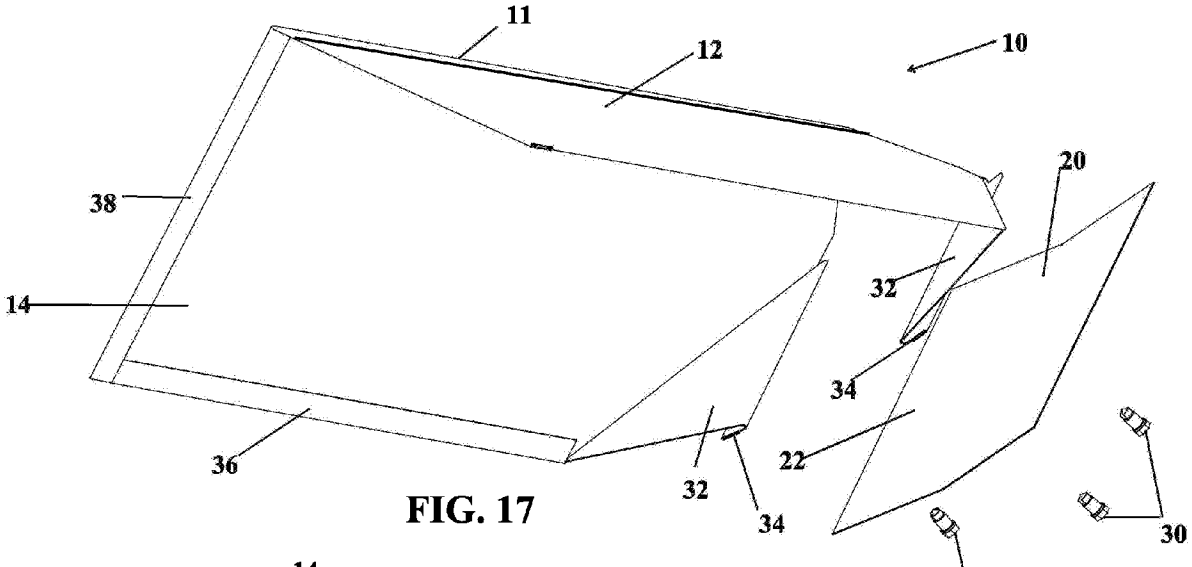
Figure 18:
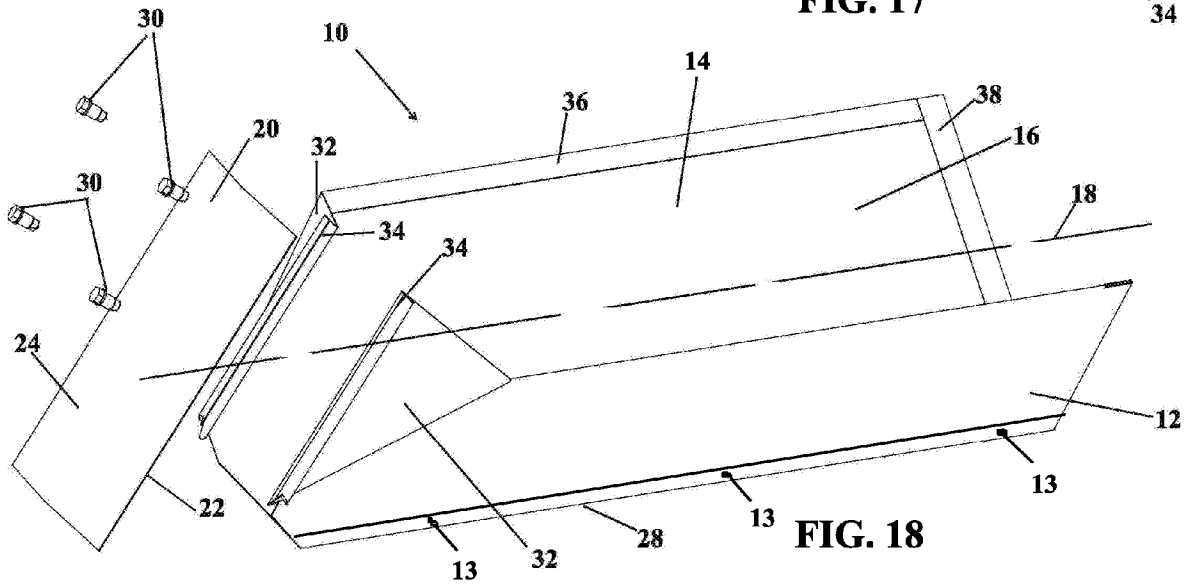

Preferably, the diverter 10 is provided as a kit which allows assembly thereof on site to accommodate various roof valley configurations. Preferably, the first and second side plates 12, 14 are joined so as to be angularly adjustable to include various acute angles therebetween. Preferably, the first and second side plates 12, 14 are formed by a single sheet which is bent to define a seam 28 which separates the first and second side plates 12, 14. In addition, it is preferred that the first and second side plates 12, 14 be bendable about the seam 28. Alternatively, the first and second side plates 12, 14 may be defined by separate plates or pieces which are joined by welding, fusion, adhesion, interlocking deformation 11 (e.g., crimping) (FIG. 17) and/or mechanical fasteners 13 (e.g., rivets) (FIG. 18). If the first and second side plates 12, 14 are joined separate pieces, the first and/or second side plate 12, 14 may be defined each by one or more of the separate pieces. Also, the seam 28 may be located along a point or line of securement between separate pieces defining the first and second side plates 12, 14 and/or formed in one or more of the separate pieces by mechanical deformation or by one or more points of weakness (e.g. thinned sections of the constituent material). In any case, it is desired to have the first and second side plates 12, 14 be separated by, and angularly adjustable about, the seam 28.

As a kit, the deflector plate 20 is provided as a separate piece, preferably having a sufficient width to accommodate a large working range of angles possibly to be included by the first and second side plates 12, 14.

In use, the first and second side plates 12, 14 are angularly adjusted to include an angle which generally conforms to the angle of the target roof valley. Once in this position, the deflector plate 20 is secured to the first and second side plates 12, 14 with the first face 22 intersecting the longitudinal axis 18. The deflector plate 20 may be dimensionally adjusted (e.g., by cutting, folding, etc.) to accommodate the desired angle of the first and second side plates 12, 14. For example, excess portions of the deflector plate 20 (portions of the deflector plate 20 extending transversely beyond the first and second side plates 12, 14 with the first and second side plates 12, 14 being in the desired angular position) may be cut or folded to conform the deflection plate 20 to the target profile of the first and second side plates 12, 14.

With securement of the deflector plate 20 to the first and second side plates 12, 14, rigidity is imposed to hold to the first and second side plates 12, 14 at the desired angular position. As will be appreciated by those skilled in the art, various modes of connecting the deflector plate 16 to the first and second side plates 12, 14 may be utilized. Preferably, mechanical fasteners 30, such as screws, may be utilized. In a preferred arrangement, the first and second side plates 12, 14 and the deflector plate 16 are formed from sheet metal with the fasteners 30 being self-tapping sheet metal screws.

Preferably, the first and second side plates 12, 14 are each provided with inwardly extending panels 32. The panels 32 are configured to be general parallel to the first face 22 to provide for general face-to-face engagement therewith in providing greater surface area for securement. The free edges 34 of the panels 32 may be bent to provide additional rigity to the panels 32. In addition, side and rear edges 36, 38 of the first and second side plates 12, 14 may be also bent to impart rigidity to the first and second side plates 12, 14. Preferably, the side and rear edges 36, 38 are bent inwardly towards the trough 16 so as to leave the outer faces of the first and second side plates 12, 14 generally flat and unobstructed. In this manner, with the diverter 10 being placed into the roof valley, the first and second side plates 12, 14 may be in the fullest face-to-face engagement that is achievable.

The gap 26 may be defined by providing one or more cut-outs 40 in the first and second side plates 12, 14 adjacent to the first face 22. In addition, or alternatively, the deflector plate 20 is secured to the first and second side plates 12, 14 so as to angularly diverge from portions of the first and second side plates 12, 14 so as to be spaced therefrom and define the gap 26 therebetween.

Optionally, the diverter 10 may be provided in an assembled state, e.g., as shown in FIGS. 3-8, ready for installation. The diverter 10 would be provided at a particular included angle between the first and second side plates 12, 14. It is possible to offer a series of assembled diverters at various included angles to cover a range of applications.

In a variation of the subject invention, and with reference to FIGS. 9-16, the deflector plate 20 may include a channel portion 42 located below the gap 26. As shown in the Figures, the channel portion 42 may be defined by one or more members 44 bent, or otherwise configured, to define a tubular shape. The fasteners 30 may be utilized to fix the one or more members 44 as needed. The channel portion 42 is located so that flow re-directed by the deflector plate 20 is caused to pass therethrough. The channel portion 42 may be inserted into a gutter or leader to direct flow thereinto.

What is claimed is:

1. A pre-assembled roof valley rain water diverter for installation into a roof valley for changing direction of rain water flowing through the roof valley, said diverter comprising:

at least first and second side plates joined together to form a trough above said first and second side plates, extending along a longitudinal axis and configured to channel a flow of rain water therethrough; and, a deflector plate, having opposing first and second faces, directly secured to at least said first and second side plates such that said first face intersects said longitudinal axis, wherein, at least one gap is defined between said first face and at least one of said first and second side plates.

2. A diverter as in claim 1, wherein said deflector plate extends from said first and second side plates to overlap said trough.

3. A diverter as in claim 2, wherein said deflector plate extends from said first and second side plates beyond said trough.

4. A diverter as in claim 1, further comprising at least one secondary member fixed to said deflector plate below said trough, said secondary member defining a closed flow path.

5. A diverter as in claim 1, wherein said first and second side plates are defined by a single sheet which is bent to define a seam, said seam separating said first and second side plates.

6. A diverter as in claim 1, wherein said first and second side plates are separate plates joined by one or more selected from the group consisting of welding, fusion, adhesion, interlocking deformation, and mechanical fasteners.

7. A method of preparing a roof valley rain water diverter for installation into a roof valley for changing direction of rain water flowing through the roof valley, said method comprising:

providing joined first and second side plates;

angularly adjusting said first and second side plates to include a selected angle corresponding generally to the included angle of the roof valley, wherein said first and second side plates disposed at the selected angle form a trough above said first and second side plates and extending along a longitudinal axis;

preparing a deflector plate, having opposing first and second faces, sized to be secured to said first and second side plates disposed at the selected angle; and, securing said deflector plate to said first and second side plates with said first and second side plates disposed at the selected angle such that said first face intersects said longitudinal axis, said securing being prior to installing said first and second side plates into the roof valley.

8. A method as in claim 7, wherein said first and second plates are defined by a single sheet bent to define a seam, said seam separating said first and second side plates.

9. A method as in claim 7, wherein said providing joined first and second side plates includes joining said first and second plates by one or more selected from the group consisting of welding, fusion, adhesion, interlocking deformation, and mechanical fasteners.

* * * * *